US006966243B1

(12) United States Patent
Liao

(10) Patent No.: US 6,966,243 B1
(45) Date of Patent: Nov. 22, 2005

(54) UNIVERSAL PLIER STRUCTURE

(76) Inventor: Wan-Yi Liao, PO Box 82-144, Taipei (TW)

( * ) Notice: Subject to any disclaimer, the term of this patent is extended or adjusted under 35 U.S.C. 154(b) by 36 days.

(21) Appl. No.: 10/968,279

(22) Filed: Oct. 20, 2004

(51) Int. Cl.[7] ..... B25B 7/12
(52) U.S. Cl. ..... 81/367; 81/368; 81/369
(58) Field of Search ..... 81/367, 368, 369, 81/370, 371, 372, 355, 359

(56) References Cited

U.S. PATENT DOCUMENTS

| | | | | |
|---|---|---|---|---|
| 4,044,413 | A * | 8/1977 | Tucker | 7/125 |
| 4,386,542 | A * | 6/1983 | Verna | 81/420 |
| 6,175,998 | B1 * | 1/2001 | Leo | 29/268 |
| 6,601,838 | B1 * | 8/2003 | Gilley | 269/37 |

* cited by examiner

*Primary Examiner*—Joseph J. Hail, III
*Assistant Examiner*—Alvin J Grant
(74) *Attorney, Agent, or Firm*—Leong C. Lei

(57) ABSTRACT

A universal plier structure is disclosed. The plier includes a plier body having an adjustable handle and a fixed handle, a suspension seat, an opening-adjusting knob, and a pad. The fixed handle has a bottom end having a first screw hole. The suspension seat has an end provided with a through hole. The opening-adjusting knob includes a screw rod and a knob head, the knob head being fitted in the suspension seat and having a center provided with a second screw hole, the screw rod having a first end engaged with the first screw hole of the fixed handle and a second end passing through the through hole of the suspension seat to engage the second screw hole of the opening-adjusting knob. The screw rod is welded to the knob head. The pad mounted between the knob head and the suspension seat.

1 Claim, 7 Drawing Sheets

UNIVERSAL PLIER STRUCTURE

BACKGROUND OF THE INVENTION (a) Technical Field of the Invention

The present invention relates to a plier structure, and in particular, a universal plier structure with an opening-adjusting knob provided with a suspension seat.

(b) Description of the Prior Art

Referring to FIG. 1, there is shown a conventional universal plier having two handles, one of the handle having a bottom connected to an adjustable knob which is used to adjust the opening of gripping for an object. The conventional plier has limited application.

FIG. 2 shows a conventional plier of Taiwanese Utility Model patent No. 185878. The patent discloses plier with a knob head which has the shape of a hat. Due to the interlinking of the hat shape adjustable knob, when a heavy object is suspended on it, the biased movement of the suspended object causes the adjustable knob to move, and this will tighten the opening of the plier. This may cause the suspended object to fall.

SUMMARY OF THE INVENTION

According, it is an object of the present invention to provide a universal plier which includes a plier body having an adjustable handle and a fixed handle, the fixed handle having a bottom end having a first screw hole, a suspension seat having an end provided with a through hole, an opening-adjusting knob including a screw rod and a knob head, the knob head being fitted in the suspension seat and having a center provided with a second screw hole, the screw rod having a first end engaged with the first screw hole of the fixed handle and a second end passing through the through hole of the suspension seat to engage the second screw hole of the opening-adjusting knob, the screw rod being welded to the knob head, and a pad mounted between the knob head and the suspension seat.

Yet another object of the present invention is to provide a universal plier structure, wherein the suspension seat can rotate in 360 degrees and the adjustable knob will not move.

Yet still another object of the present invention is to provide a universal plier structure, wherein the tightness of holding of the plier will not be affected by the movement of the opening-adjustable knob.

A further object of the present invention is to provide a universal pliers structure, wherein the opening-adjusting knob will not be rotated as a result of the heavy suspended object.

Still a further object of the present invention is to provide a universal plier structure, wherein the suspension seat allows the plier to be suspended onto a wall or any position which can be suspended.

The foregoing object and summary provide only a brief introduction to the present invention. To fully appreciate these and other objects of the present invention as well as the invention itself, all of which will become apparent to those skilled in the art, the following detailed description of the invention and the claims should be read in conjunction with the accompanying drawings. Throughout the specification and drawings identical reference numerals refer to identical or similar parts.

Many other advantages and features of the present invention will become manifest to those versed in the art upon making reference to the detailed description and the accompanying sheets of drawings in which a preferred structural embodiment incorporating the principles of the present invention is shown by way of illustrative example.

DETAILED DESCRIPTION OF THE PREFERRED EMBODIMENTS

The following descriptions are of exemplary embodiments only, and are not intended to limit the scope, applicability or configuration of the invention in any way. Rather, the following description provides a convenient illustration for implementing exemplary embodiments of the invention. Various changes to the described embodiments may be made in the function and arrangement of the elements described without departing from the scope of the invention as set forth in the appended claims.

Figure 1:
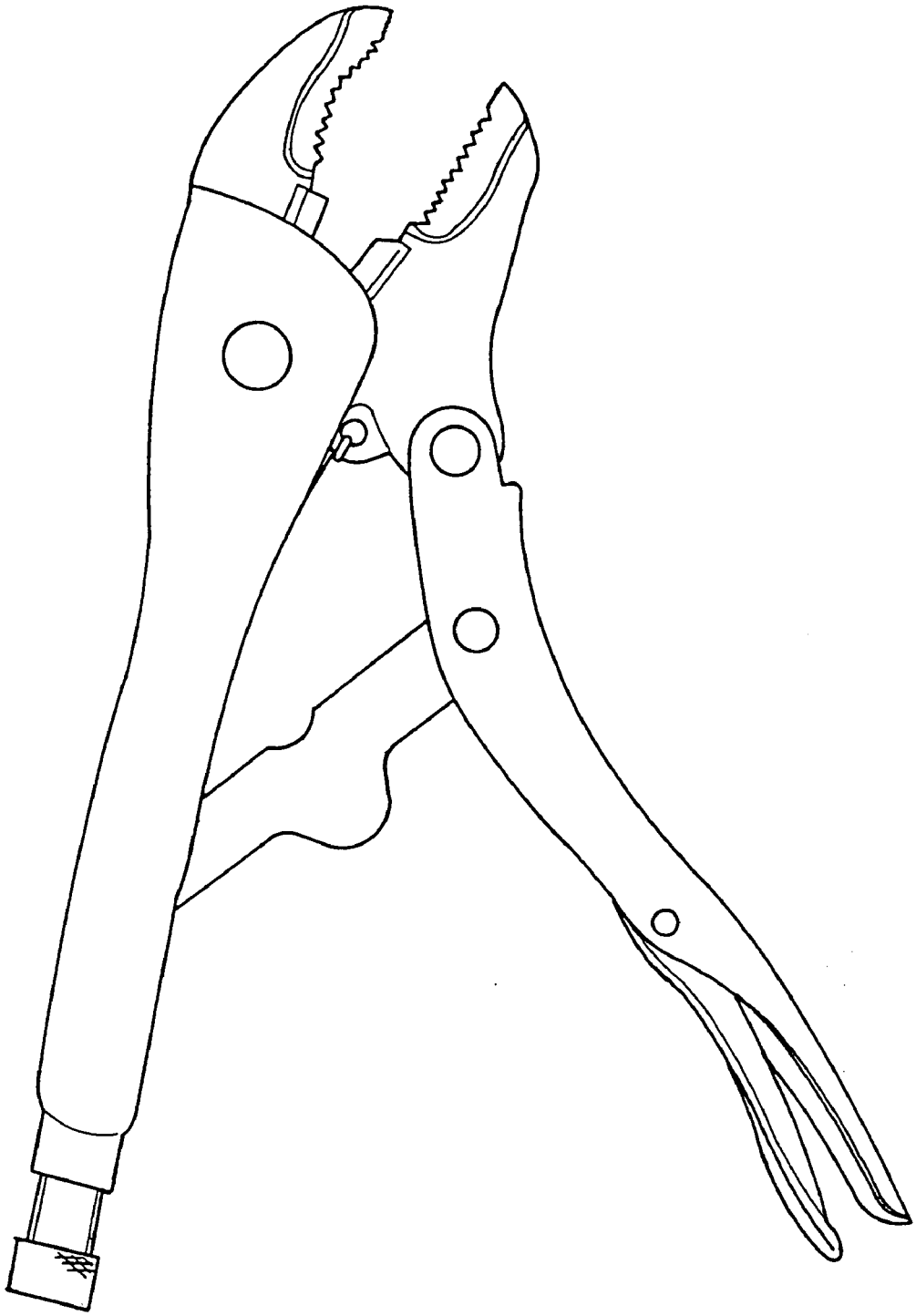
PRIOR ART FIG. 1
FIG. 1 is a perspective view of a conventional plier.
Figure 2:
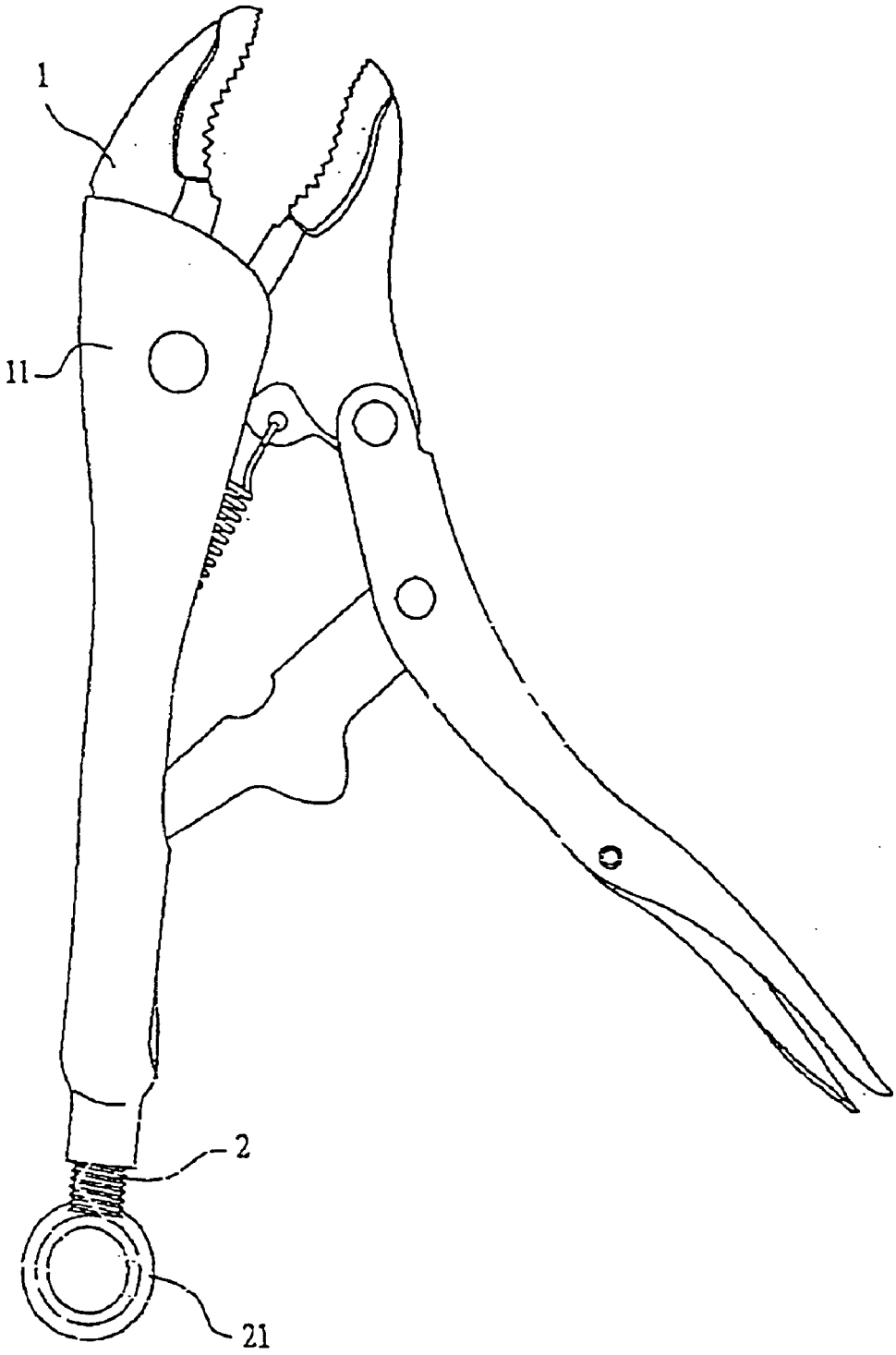
PRIOR ART FIG. 2
FIG. 2 shows FIG. 1 of Taiwan Utility Publication No. 474240.
Figure 3:
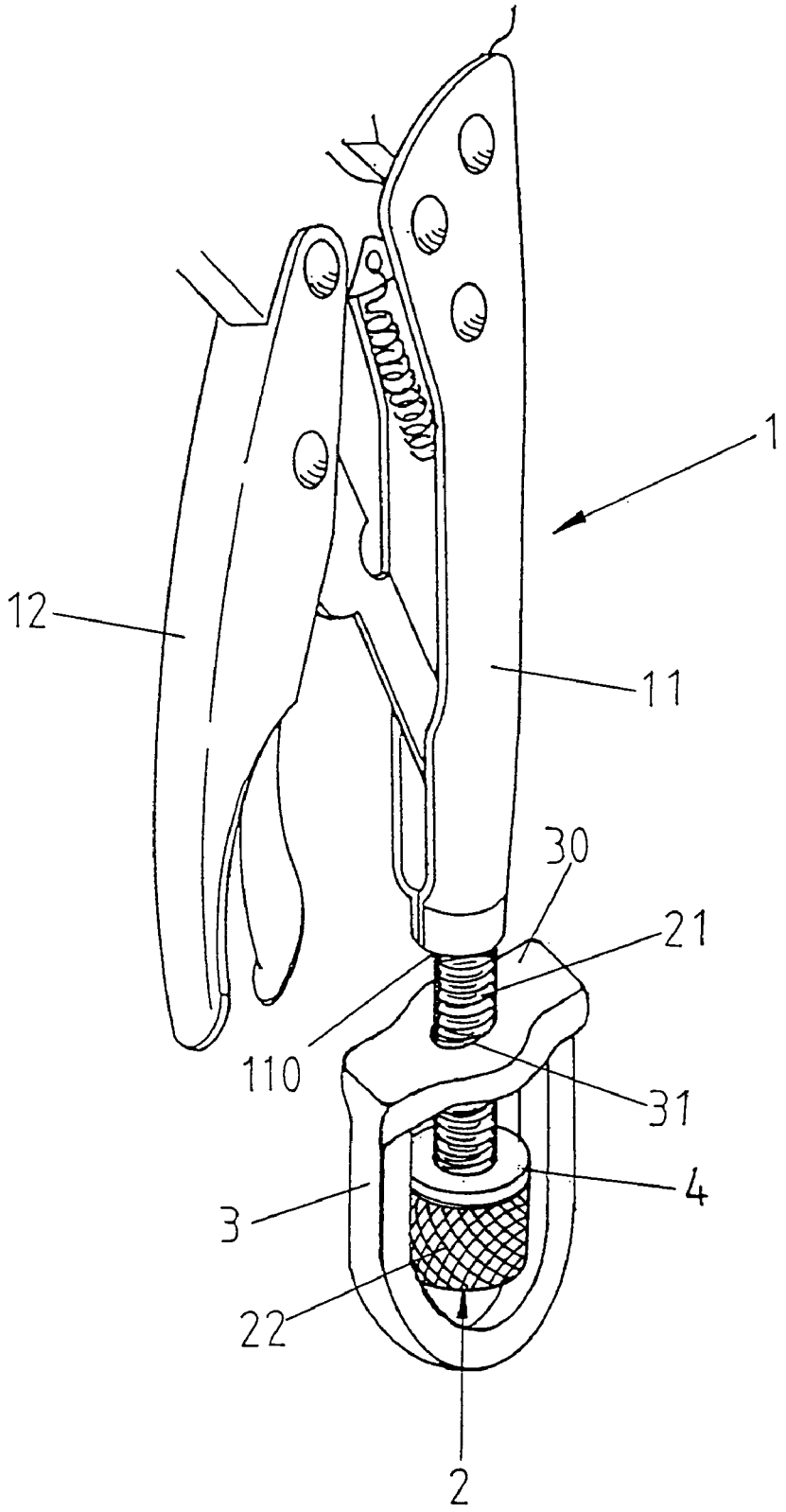
FIG. 3 is a perspective view of the present invention.
Figure 4:
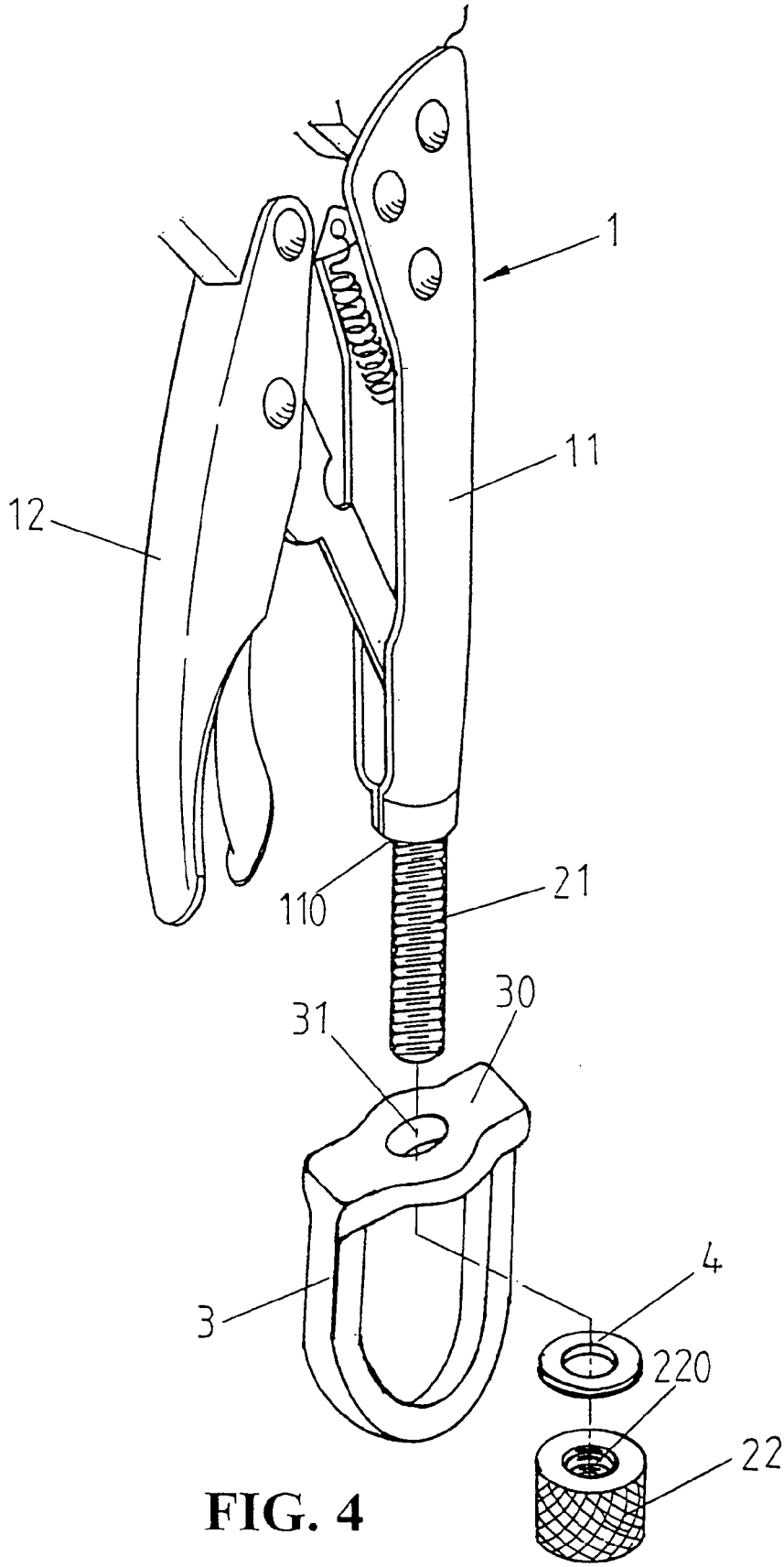
FIG. 4 is a perspective exploded view of the present invention.
Figure 5:
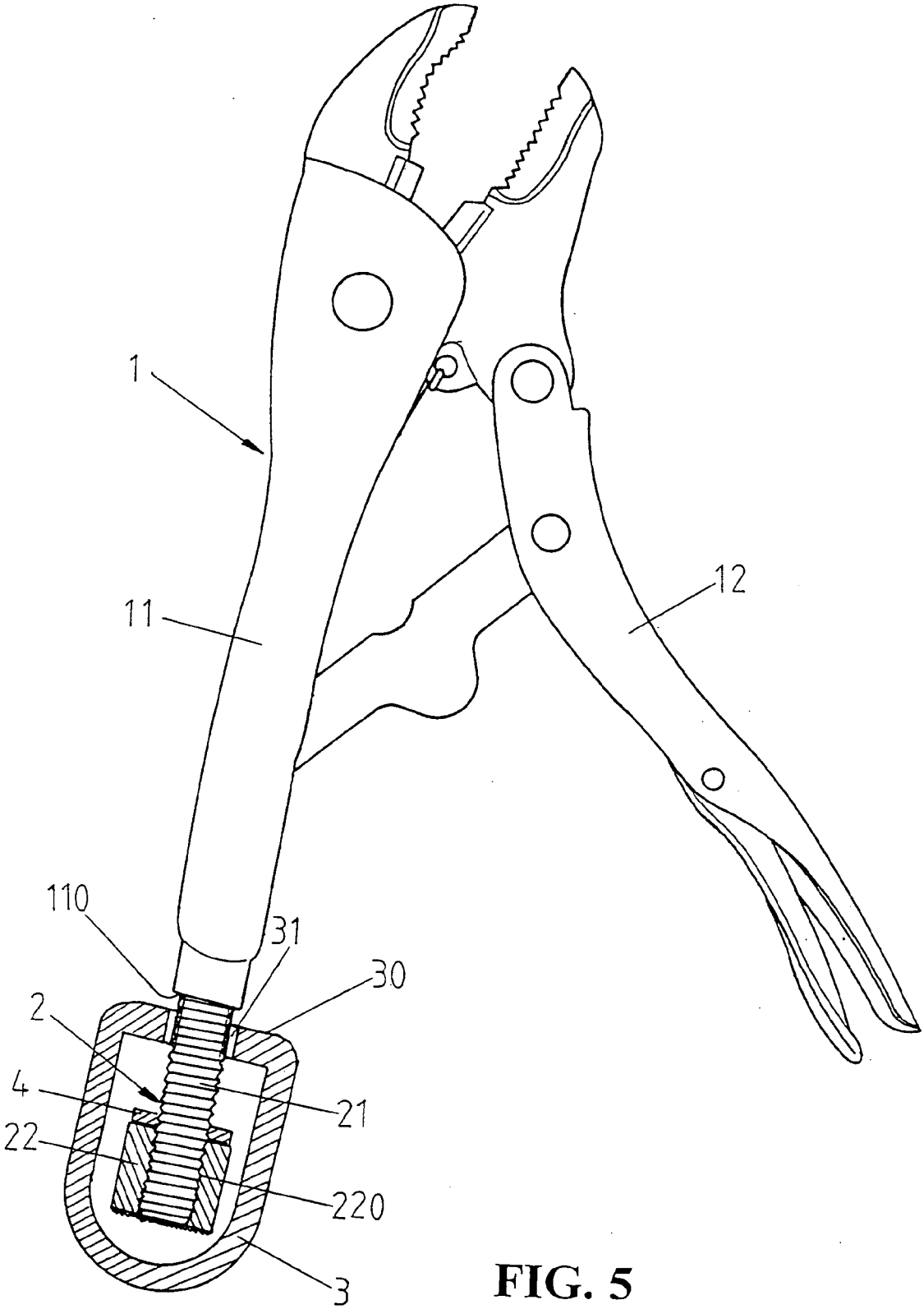
FIG. 5 is a sectional view of the present invention.

Referring FIGS. 3, 4, and 5, there is shown a universal plier structure, comprising a plier body 1, an opening-adjusting knob 2, a suspension seat 3, and a pad 4. The plier body 1 has an adjustable handle 12 and a fixed handle 11, and the bottom end of the fixed handle 11 has a screw hole 110.

The opening-adjusting knob 2 includes a screw rod 21 and a knob head 2, and the center of the knob head 22 has a screw hole 220.

The suspension seat 3 is substantially a rim-like structure having an upper end provided with an enhancement end face 30, and the top section thereof has a through hole 31.

The screw rod 21 of the opening-adjusting knob 2 is inserted into the through hole 31 of the end face 30 at the upper end of the suspension seat 3 to the space within the suspension seat 3 and is engaged with the screw hole 220 at the center of the knob head 22.

A metallic pad 4 is provided between the upper end of the knob head 22 and the suspension seat 3, and the screw rod 21 and the knob head 22 are welded together to form one body. This will form into a restrictive suspension seat 3 and the opening-adjusting knob 2. The screw rod 21 is turned into the screw hole 110 at the bottom end of the fixed handle 11. Thus the plier is provided with an adjustable knob which can adjust the screw rod distance and has a rotatable suspension seat.

Figure 6:
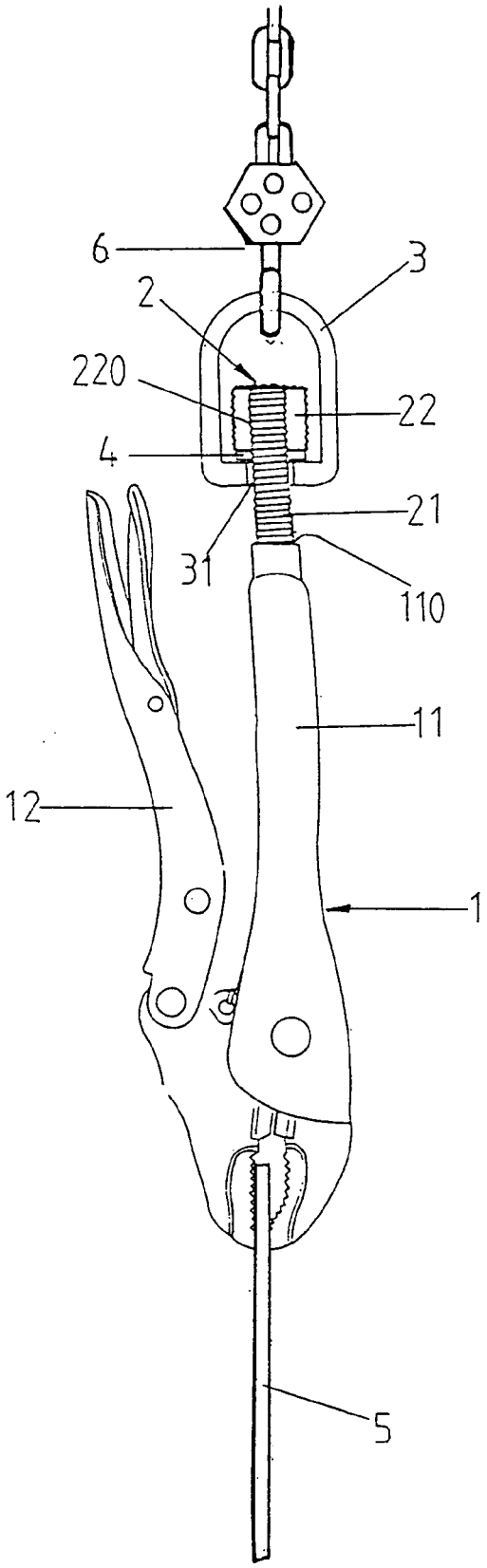
FIG. 6 is a schematic view of another preferred embodiment of the present invention.

Referring to FIG. 6, there is shown another preferred embodiment in accordance with the present invention. The opening 10 of the plier body 1 is dependent on the gripping of the two handles 11, 12 on a working piece 5. If the plier is holding an object or a working piece in a vertical position, and the tightness of the opening of the plier has been adjusted using the adjustable knob to grip on object when the suspended working piece 5 will not rotate to drive the opening-adjusting knob 2. Thus, the suspended object will not be easily released.

Figure 7:
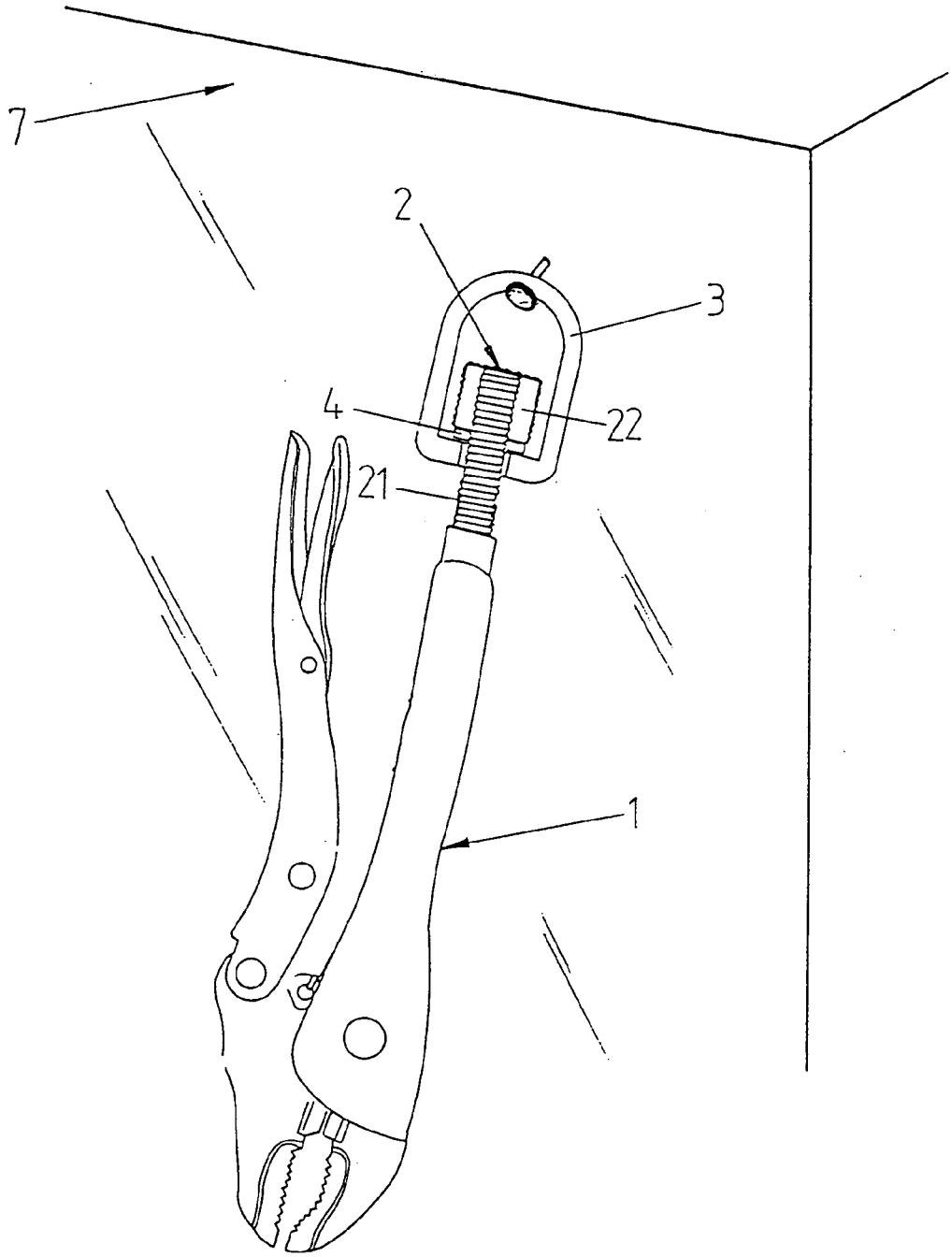
FIG. 7 is a schematic view of a further preferred embodiment of the present invention.

Referring to FIG. 7, there is shown another preferred embodiment of the universal plier. The end hole at the bottom end of the fixed handle 11 is locked to an opening-adjusting knob 2 and the suspension seat. Thus, when the plier body 1 is suspended onto the wall 7 or any like object, the opening-adjusting knob will not be affected.

It will be understood that each of the elements described above, or two or more together may also find a useful application in other types of methods differing from the type described above.

While certain novel features of this invention have been shown and described and are pointed out in the annexed claim, it is not intended to be limited to the details above, since it will be understood that various omissions, modifications, substitutions and changes in the forms and details of the device illustrated and in its operation can be made by those skilled in the art without departing in any way from the spirit of the present invention.

I claim:

1. A universal plier structure comprising:

a plier body having an adjustable handle and a fixed handle, said fixed handle having a bottom end having a first screw hole;

a suspension seat having an end provided with a through hole;

an opening-adjusting knob including a screw rod and a knob head, said knob head being fitted in said suspension seat and having a center provided with a second screw hole, said screw rod having a first end engaged with said first screw hole of said fixed handle and a second end passing through said through hole of said suspension seat to engage said second screw hole of said opening-adjusting knob, said screw rod being welded to said knob head; and a pad mounted between said knob head and said suspension seat.

* * * * *